US008011349B2

(12) United States Patent
Felton

(10) Patent No.: US 8,011,349 B2
(45) Date of Patent: Sep. 6, 2011

(54) FUEL INJECTION SYSTEM

(75) Inventor: George Nicholas Felton, Gillingham (GB)

(73) Assignee: Delphi Technologies Holdings S.arl, Troy, MI (US)

( * ) Notice: Subject to any disclaimer, the term of this patent is extended or adjusted under 35 U.S.C. 154(b) by 341 days.

(21) Appl. No.: 12/315,075

(22) Filed: Nov. 26, 2008

(65) Prior Publication Data

US 2009/0138179 A1 May 28, 2009

(30) Foreign Application Priority Data

Nov. 26, 2007 (EP) ..... 07254582

(51) Int. Cl.
*F02M 37/00* (2006.01)

(52) U.S. Cl. ..... 123/436; 123/447; 123/457; 123/512

(58) Field of Classification Search ..... 701/103–105, 701/110; 123/447, 456, 457, 497, 436, 502, 123/510, 511, 512
See application file for complete search history.

(56) References Cited

U.S. PATENT DOCUMENTS

| | | | | |
|---|---|---|---|---|
| 5,678,521 | A * | 10/1997 | Thompson et al. | 123/447 |
| 6,095,118 | A * | 8/2000 | Klinger et al. | 123/446 |
| 6,253,735 | B1 * | 7/2001 | Miyajima | 123/456 |
| 6,668,800 | B2 * | 12/2003 | Ricco et al. | 123/446 |
| 6,823,844 | B2 * | 11/2004 | Steinbrenner et al. | 123/446 |
| 7,182,067 | B2 * | 2/2007 | Ricco et al. | 123/446 |
| 7,406,949 | B2 * | 8/2008 | Puckett | 123/486 |
| 7,415,972 | B2 * | 8/2008 | Ogawa | 123/495 |
| 7,517,200 | B2 * | 4/2009 | Ferleyko et al. | 417/53 |
| 7,823,566 | B2 * | 11/2010 | Fox et al. | 123/500 |
| 2004/0109768 | A1 * | 6/2004 | Sommars et al. | 417/307 |
| 2004/0208753 | A1 | 10/2004 | Mori | |
| 2006/0144368 | A1 | 7/2006 | Knight et al. | |
| 2007/0217925 | A1 * | 9/2007 | Tian et al. | 417/279 |

FOREIGN PATENT DOCUMENTS

| | | |
|---|---|---|
| DE | 10036772 | 2/2002 |
| DE | 10341788 | 4/2005 |
| DE | 10361579 | 7/2005 |
| EP | 1489293 | 12/2004 |

(Continued)

OTHER PUBLICATIONS

European Search Report dated Apr. 10, 2008.

(Continued)

*Primary Examiner* — Hai H Huynh
(74) *Attorney, Agent, or Firm* — Thomas N. Twomey

(57) ABSTRACT

A fuel injection system for an internal combustion engine comprises a plurality of pumps arranged to supply respective flows of pressurized fuel to a common accumulator volume that supplies the pressurized fuel in turn to a plurality of fuel injectors. An engine control unit controls the flow rate of pressurized fuel into the accumulator volume in response to engine load. The flow rate of pressurized fuel from at least one pump of the plurality is dependent upon engine speed; whereas at least one other pump of the plurality comprises a fuel output control responsive to the engine control unit enabling the flow rate of pressurized fuel from that pump to be varied independently of engine speed. In this way, the engine control unit controls the aggregate flow rate of pressurized fuel from the pumps into the accumulator volume, while controlling only one of the pumps. This reduces the cost of control apparatus and allows greater freedom of pump selection and flow circuit design.

18 Claims, 6 Drawing Sheets

FOREIGN PATENT DOCUMENTS

| | | |
|---|---|---|
| JP | 2003-113741 | 4/2003 |
| JP | 2004-278491 | 10/2004 |
| JP | 2004-316518 | 11/2004 |
| JP | 2005-351135 | 12/2005 |

OTHER PUBLICATIONS

Japan Office Action dated Oct. 29, 2010.
Japan Office Action dated May 6, 2011.

* cited by examiner

FUEL INJECTION SYSTEM

TECHNICAL FIELD

This invention relates to a fuel injection system for a compression ignition internal combustion engine. In particular, the invention relates to a fuel injection system that includes a plurality of pumps, preferably a plurality of unit pumps. The invention also relates to an engine installation incorporating such a fuel injection system.

BACKGROUND OF THE INVENTION

A known fuel injection system may include a plurality of unit pumps, each delivering fuel at high pressure to a respective, separate high pressure fuel line. Each unit pump typically includes a tappet that is driven by a cam to impart drive to a plunger, thereby causing the plunger to reciprocate, in turn, pressurizing fuel within a pumping chamber of the unit. Each unit pump is arranged to supply fuel to an injection nozzle of a respective dedicated injector so as to facilitate delivery of fuel to an associated cylinder of the engine. In such fuel injection systems, it is, therefore, necessary to provide each engine cylinder with a set of separate pump components, each consisting of a cam, a tappet, a unit pump, a high pressure line and an injector, wherein the cams for each set of pump components, typically, are carried on a common camshaft.

The cam of each unit pump is suitably mounted upon and driven by a camshaft that also carries the cams that control engine valve timing. In that case, the unit pumps are spaced in line along the axis of the camshaft, with a drive end of each unit pump co-operating with a lobe or lobes of its associated cam and the injection nozzle end of each unit pump being arranged to deliver fuel to the associated engine cylinder. Typically, the camshaft has at least three lobes associated with each engine cylinder; one for driving the associated pumping plunger and the other two for controlling engine valve timing. The camshaft extends through the crankcase of the engine, which is provided with pockets or bores for accommodating the unit pumps. The unit pumps are all therefore effectively housed within a common engine housing. For the purpose of this specification, any reference to the camshaft "carrying" a cam is intended to include carrying or mounting a separate cam upon the camshaft, or integrally forming the cam with the camshaft.

Fuel injection pumps are known wherein a plurality of pumping elements or plungers are incorporated within a unitary housing. Such arrangements are commonly referred to as 'in-line' pump arrangements, as the pumping elements are mounted in a line parallel to the axis of a camshaft that drives the plungers. Such systems require a set of tappets and a set of pumping plungers, one tappet and one plunger for each engine cylinder, with each tappet and its associated plunger being arranged within the associated unitary housing. As in unit pump arrangements, each pumping element has an associated pumping chamber that is connected to its associated injector through a separate high pressure fuel line. As a separate pumping element is provided for each engine cylinder, again, the costs of such systems are relatively high.

Common rail fuel injection systems are also known and typically include a common rail fuel pump having a plurality of pumping plungers driven by a common eccentric cam surface. The cam surface is rotatable by means of a drive shaft, and such pumps may include three or more plungers radially spaced around the drive shaft. The cam surface of the pump co-operates with all of the plungers to cause phased, cyclical movement of the plungers and, hence, pressurization of fuel within their associated pumping chambers. That pressurized fuel is fed to a common rail accumulator volume that in turn supplies fuel to all of the injectors of the system. Whilst common rail systems such as this avoid the need for one pumping element per engine cylinder, such radial pump arrangements are incompatible with existing in-line cam drive arrangements such as that described previously and hence a totally different engine layout is required to accommodate the system.

The machining and assembly line facilities for the manufacture of engine installations having unit pump fuel injection are well established, and engine installations that can accommodate unit pump fuel injection systems are widely used. It is therefore desirable to permit continued use of such existing production facilities and engine installations. However, it is also desirable to avoid or at least to mitigate several disadvantages associated with fuel injection systems having a plurality of unit pumps.

SUMMARY OF THE INVENTION

In EP 1336752, for example, the Applicant recognized that systems comprising one unit pump per fuel injector suffer from a high part count and therefore high cost. To solve this problem while retaining the basic unit pump engine architecture, EP 1336752 proposed a fuel injection system comprising two or more unit pumps and a greater plurality of fuel injectors. Typically for engines with four to six cylinders, two or three unit pumps may be used whereas engines with six or eight cylinders may use three or four unit pumps, for example. Pressurized fuel from the pumping chambers of the unit pumps is fed directly to an accumulator volume, such as a common rail, through respective high pressure fuel lines; the accumulator volume in turn supplies pressurized fuel to all of the injectors of the system.

Previously, unit pumps were only known in fuel injection systems wherein they supply fuel directly to a dedicated fuel injector. In contrast, the unit pumps in EP 1336752 deliver fuel to the injectors indirectly, with each unit pump delivering fuel through its associated high-pressure fuel line to a separate, intermediate fuel volume (in the form of the common rail) from where fuel is delivered to the injectors.

The fuel injection system of EP 1336752 can be incorporated readily into existing engine installations that were originally intended for use with separate unit fuel injection pumps delivering fuel to dedicated fuel injectors, while preserving the existing engine layout. In particular, there is no need to modify the existing pump mounting, camshaft location or cam drives. Production costs associated with re-tooling an engine production line can therefore be reduced or avoided.

Moreover the unit pumps of EP 1336752 have inlet metering arranged to control the rate of flow of fuel into the pumping chamber, thereby to control the quantity of fuel to be pressurized within the pumping chamber during a pumping cycle. This improves efficiency as only the quantity of fuel that is required for an injection event is pumped during a pumping cycle of each of the unit pumps. In previous fuel injection systems associated with this type of engine installation, an excess quantity of fuel is pumped on each pumping stroke, with the excess being spilled to low pressure before delivery to the injectors. The fuel injection system of EP 1336752 improves efficiency because the quantity of fuel pumped during each pumping cycle is controlled by the inlet metering valve.

FIG. 6 of EP 1336752 discloses an arrangement of two unit pumps supplied through a common inlet metering system, with one of the unit pumps having an inlet metering valve and the other of the unit pumps being supplied with fuel from the inlet metering valve of the first unit pump. This is more expensive than simpler systems using uncontrolled unit pumps and requires careful matching of the performance of the two pumps and flow circuit design to achieve optimum output characteristics, especially as only one control means is used.

The present invention seeks to solve these problems of prior injection systems by reducing the cost of control apparatus and by allowing greater freedom of pump selection and flow circuit design.

The invention resides in a fuel injection system for an internal combustion engine, the system comprising:

a plurality of pumps arranged to supply respective flows of pressurized fuel to a common accumulator volume that supplies the pressurized fuel in turn to a plurality of fuel injectors;

an engine control unit for controlling the flow rate of pressurized fuel into the accumulator volume in response to engine load; and an engine load data input for inputting engine load data to the engine control unit;

wherein the flow rate of pressurized fuel from at least one first pump of the plurality is dependent upon engine speed; and at least one second pump of the plurality comprises a fuel output control responsive to the engine control unit enabling the flow rate of pressurized fuel from that pump to be varied over a range of settings at a given engine speed, whereby the engine control unit controls the aggregate flow rate of pressurized fuel from the pumps into the accumulator volume.

In the system of the invention, the first pump preferably has substantially constant delivery at a given engine speed and the second pump has variable delivery over a range of settings at that engine speed. Thus, control of just the second pump is sufficient to control the aggregate flow rate of pressurized fuel into the accumulator volume: the first pump needs no control system.

The fuel output control may comprise an inlet metering valve arranged to control the rate of flow of fuel into the second pump. Alternative arrangements may comprise a solenoid-controlled spill valve acting on the second pump, or a mechanical control that alters the effective stroke of a plunger of the second pump. Such a mechanical control may comprise a rack that acts on the plunger of the second pump and that may be actuated by a stepper motor.

The pumps may be unit pumps that may have a cam-driven tappet drive arrangement or a shoe and roller drive arrangement, for example. It is also possible for the pumps to be pumping units of a rotary drive pump wherein the pumping units of the rotary drive pump may be disposed within a common housing.

The accumulator volume is suitably a common rail, and the number of fuel injectors is preferably greater than the number of unit pumps.

The invention may also be expressed as a fuel injection system for an internal combustion engine, the system comprising:

a plurality of pumps arranged to supply respective flows of pressurized fuel to a common accumulator volume that supplies the pressurized fuel in turn to a plurality of fuel injectors;

an engine control unit for controlling the flow rate of pressurized fuel into the accumulator volume in response to engine load; and an engine load data input for inputting engine load data to the engine control unit;

wherein at least one pump of the plurality has an uncontrolled fuel output; and at least one other pump of the plurality comprises a fuel output control responsive to the engine control unit to control the aggregate flow rate of pressurized fuel from the pumps into the accumulator volume wherein the flow rate of pressurized fuel from the at least one other pump is capable of being varied over a range of settings at a given engine speed.

The inventive concept extends to a method of operating a fuel injection system of an internal combustion engine, the method comprising:

driving a plurality of pumps to supply respective flows of pressurized fuel to a common accumulator volume; and controlling the flow rate of pressurized fuel from at least one, but less than all, of the plurality of pumps in response to engine load to control the aggregate flow rate of pressurized fuel from the pumps into the accumulator volume wherein the flow rate of pressurized fuel from at least one of the plurality of pumps is varied over a range of settings at a given engine speed.

The flow rate of pressurized fuel from at least one of the plurality of pumps may be dependent on engine speed, and the flow rate of pressurized fuel from at least one other of the plurality of pumps may be varied independently of engine speed, such that the flow rate of pressurized fuel may be varied over a range of settings at a given engine speed.

The inventive concept also embraces an engine fitted with the fuel injection system of the invention or capable of operating in accordance with the method of the invention.

The invention may therefore be embodied as a common rail fuel system with two different unit pumps as the high pressure supply source. The first pump has substantially constant delivery and does not require a control system; the second pump has variable delivery achieved by inlet metering or other means. The first pump may be configured to give a fuel delivery rate sufficient for idling and low load operation; the second pump then need only be activated when higher fuel flow rates are required, such as during medium- and high-load operation or engine starting. The system has the potential for low cost as the need to control two pumps is avoided.

The second pump with variable delivery can be controlled by limiting the inlet flow to the pumping chamber—known as inlet metering—or by using a solenoid valve to allow excess fuel to flow back from the pumping chamber at low pressure when not required and hence control the effective stroke, as is done in an EUI (electronic unit injector) or an EUP (electronic unit pump). Theoretically mechanical control, as used in a mechanical unit pump, could also be used with rack actuation, for example, by a stepper motor.

The system is especially suitable for use in engines for cost-sensitive markets where the resulting higher level of pressure fluctuation and drive torque can be accepted. The system gives better efficiency than one wherein completely uncontrolled pumps are used and wherein surplus high pressure fuel is discharged from the system by, for example, a high pressure discharge valve on the rail.

The principle of the invention can also be used in a rotary drive pump containing two or more pumping units within a common housing.

The invention resides in a fuel injection system for an internal combustion engine, the system comprising:

a plurality of pumps arranged to supply respective flows of pressurized fuel to a common accumulator volume that supplies the pressurized fuel in turn to a plurality of fuel injectors;

an engine control unit for controlling the flow rate of pressurized fuel into the accumulator volume in response to engine load; and an engine load data input for inputting engine load data to the engine control unit;

wherein the flow rate of pressurized fuel from at least one first pump of the plurality is dependent upon engine speed; and at least one second pump of the plurality comprises a fuel output control responsive to the engine control unit enabling the flow rate of pressurized fuel from that pump to be varied independently of engine speed, whereby the engine control unit controls the aggregate flow rate of pressurized fuel from the pumps into the accumulator volume.

The invention may also be expressed as a fuel injection system for an internal combustion engine, the system comprising:

a plurality of pumps arranged to supply respective flows of pressurized fuel to a common accumulator volume that supplies the pressurized fuel in turn to a plurality of fuel injectors;

an engine control unit for controlling the flow rate of pressurized fuel into the accumulator volume in response to engine load; and an engine load data input for inputting engine load data to the engine control unit;

wherein at least one pump of the plurality has an uncontrolled fuel output; and at least one other pump of the plurality comprises a fuel output control responsive to the engine control unit to control the aggregate flow rate of pressurized fuel from the pumps into the accumulator volume.

The inventive concept extends to a method of operating a fuel injection system of an internal combustion engine, the method comprising:

driving a plurality of pumps to supply respective flows of pressurized fuel to a common accumulator volume; and controlling the flow rate of pressurized fuel from at least one, but less than all, of the plurality of pumps in response to engine load to control the aggregate flow rate of pressurized fuel from the pumps into the accumulator volume.

BRIEF DESCRIPTION OF THE DRAWINGS

In order that the invention may be readily understood, reference will now be made, by way of example only, to the accompanying drawings, in which.

DESCRIPTION OF THE PREFERRED EMBODIMENT

Figure 1:
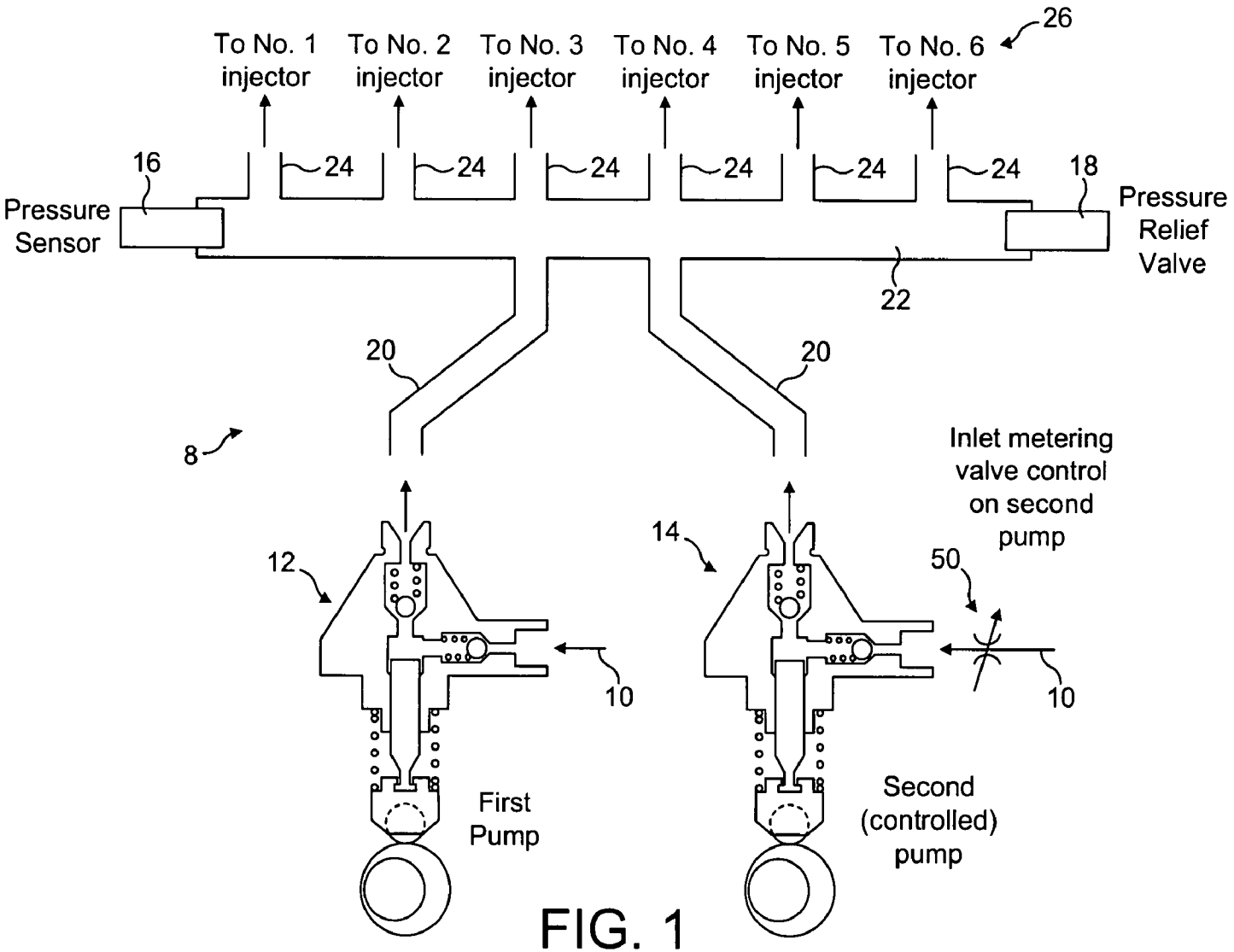
FIG. 1 is a schematic diagram of a fuel injection system in accordance with one embodiment of the present invention, comprising two unit pumps.

Referring firstly to FIG. 1, a common rail fuel injection system 8 for an internal combustion engine receives fuel drawn from a low pressure reservoir through a filter by a low pressure pump. Those components are well known and entirely routine in the art and so are omitted from the drawings for clarity. That fuel is supplied through respective first supply lines 10 to the inlets of first and second high-pressure unit pumps, referred to generally as 12 and 14 respectively. The first unit pump 12 has no control apparatus. The second unit pump 14 has control apparatus that, in this embodiment, comprises an inlet metering control valve shown schematically at 50. Inlet metering limits the inlet flow to the pumping chamber and thereby controls the output of the second unit pump 14 to suit the varying load on the engine as will be described.

Each unit pump 12, 14 pressurizes a quantity of fuel to a substantially higher pressure than the output of the low-pressure pump, and delivers that high-pressure fuel though respective second supply lines 20 to an accumulator volume in the form of a common rail 22. Thus, each unit pump 12, 14 has a pump outlet that is spaced from a respective inlet to the accumulator volume or common rail.

In conventional manner, the common rail 22 includes a pressure sensor 16, a pressure relief valve 18 and a plurality of high-pressure fuel lines 24 that extend from and are spaced along the rail 22. Each high-pressure fuel line 24 is arranged to supply fuel to a respective injector 26 of the fuel system, from which fuel is delivered to an associated engine cylinder or other combustion space. Six high-pressure fuel lines 24 and injectors 26 in the embodiment shown mean that the system of FIG. 1 is suitable for a six-cylinder compression ignition engine.

The injectors of the fuel system are therefore spaced apart from the unit pumps.

The common rail 22 shown in FIG. 1 is of axially-extending tubular configuration but the rail may alternatively be of generally spherical configuration, that is of the type having a central hub, from which radially-extending delivery flow paths extend to the injectors.

The injectors 26 may be of any conventional type, the design and operation of which will be well known to those familiar with the art. For example, the injector may be of an electromagnetically- or piezoelectrically-actuable type, may be of the direct actuation type or may be of the type including a hydraulic amplifier arrangement for controlling injector valve needle movement.

Whilst not shown in FIG. 1, the fuel injection system 8 may be incorporated within an engine installation that includes an engine housing, typically the engine crankcase. The engine housing may have a plurality of pockets that each receive a respective one of the unit pumps 12, 14. For example, the engine housing may define an axially-extending opening, through a camshaft extends, in use, with the pockets being arranged to extend radially from the opening. The opening may be defined in an integral or unitary engine housing or, alternatively, may be defined by adjacently mounted engine housing parts.

Two or more high-pressure unit pumps 12, 14 are provided in the system 8 but for clarity and simplicity only the second unit pump 14 will now be described in detail with reference to FIG. 2. The inlet metering control valve 50 of the second unit pump 14 will be described in detail thereafter with reference to FIG. 3. The description of the second unit pump 14 with reference to FIG. 2 will also suffice to explain the operation of the first unit pump 12, which operates in much the same way as the second unit pump 14, but which omits its inlet metering control valve 50.

Figure 2:
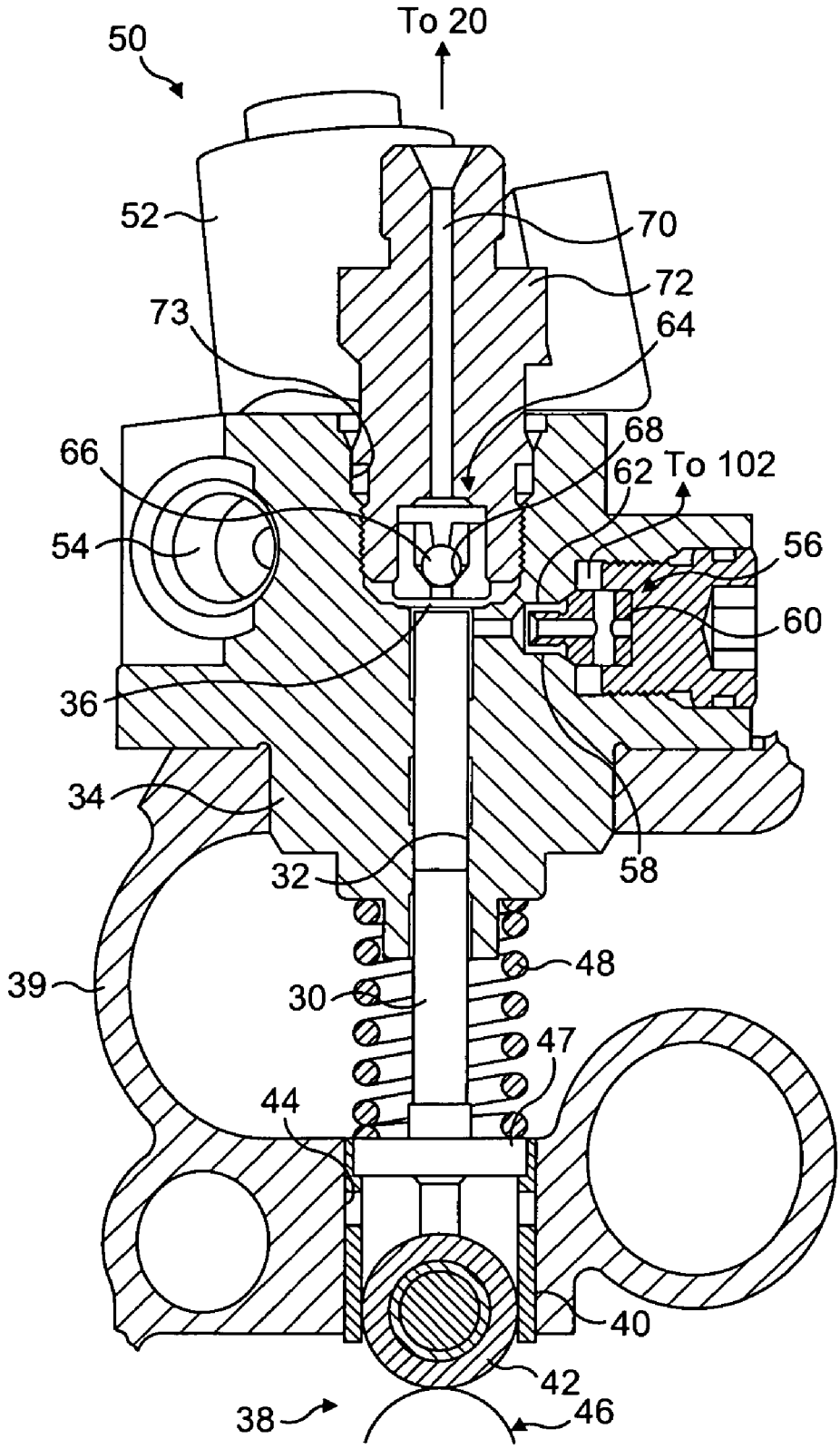
FIG. 2 is a partial sectional view of one of the unit pumps of the fuel injection system in FIG. 1.

Referring to FIG. 2, it can be seen that the unit pump 14 includes a single pumping plunger 30 that is slideable within a plunger bore 32 provided in a pump housing 34 to pressurize fuel within a pumping chamber 36. The pumping plunger 30 is driven, in use, by a drive arrangement referred to generally as 38, including a generally cylindrical tappet member 40, a roller member 42 and a cam carried by a drive shaft.

The drive shaft is not shown in FIG. 2 but is visible schematically in FIG. 1: in practice a single camshaft can drive both pumps 12 and 14 via respective cam lobes spaced along the camshaft to align with the pumps 12 and 14. The camshaft may be of the type used in engine installations as described previously, that is, installations originally intended to include separate unit fuel injection pumps that each deliver fuel to a dedicated injector. In such existing engine installations, the camshaft carries a plurality of lobes or cam forms, each intended to drive a plunger of a respective one of the unit fuel injection pumps.

In the system 8 of FIG. 1, the existing cam drive arrangement is used in a different manner, but nonetheless the requirement to redesign the engine installation can be substantially avoided. Specifically the unit pumps 12 and 14 are arranged in a line substantially parallel to the axis of the camshaft, and are accommodated within a common engine housing provided with a plurality of pockets or bores, each of the unit pumps 12, 14 being mounted within a respective one of the pockets or bores. Typically the engine housing may take the form of the engine crankcase, which is provided with an axially-extending opening, through which the camshaft extends. The pockets for receiving the unit pumps extend radially from this opening, and thus define the locations for the unit pumps within the installation. As the unit pumps 12, 14 of the fuel injection system 8 do not supply fuel directly to just one injector, the operating principle of the system contrasts to that of systems that pre-date EP 1336752. However by making the fuel injection system 8 compatible with those previous engine installations, the need to re-design existing engine installations and tooling equipment is advantageously avoided.

As seen in FIG. 2, the roller 42 is arranged to co-operate with a surface 46 of the cam such that, as the drive shaft rotates, the cam is driven and the roller 42 is caused to ride over the cam surface 46. The roller 42 and the tappet 40 are reciprocable within a guide bore 44 provided in an engine housing 39 that is secured to the pump housing 34. An internal surface of the tappet 40 is provided with an annular groove, within which an abutment plate 47 for a return spring 48 is mounted. The return spring 48 is arranged to urge the tappet and roller arrangement 40, 42 outwardly from the guide bore 44 (downward in the orientation shown in FIG. 2) into engagement with the cam surface and, hence, serves to allow the pumping plunger 30 to be urged outwardly from the plunger bore 32 to perform a return stroke of a pumping cycle, as described in further detail below. The tappet 40 and pumping plunger 30 are arranged such that they are able to move axially relative to one another. Thus, as the tappet 40 is urged inwardly within the guide bore 44 upon rotation of the cam surface, a point will be reached in its range of travel, at which it moves into engagement with the pumping plunger 30 to urge the pumping plunger inwardly within the plunger bore 32.

An efficiency advantage is achieved by virtue of an inlet metering valve arrangement, referred to generally as 50, that is provided on the second unit pump 14. The inlet metering valve arrangement 50 is located at the end of the pumping plunger 30 remote from the tappet 40, and is located within a separate valve housing 52 secured to a face of the pump housing 34. The inlet metering valve 50 is in communication with a pump inlet 54 that communicates with the first supply line 10 in FIG. 1, such that a supply of low-pressure fuel is delivered to the inlet metering valve 50 from a low pressure pump. The inlet metering valve 50 is arranged to control the rate of flow of fuel delivered to the pumping chamber 36 of the second unit pump 14 through an inlet check valve, referred to generally as 56, under the control of an Engine Control Unit or ECU 74 shown in the system block diagram of FIG. 4.

Whilst the inlet metering valve 50 shown here includes a valve housing that is adapted to be mounted to the unit pump housing, the inlet metering valve arrangement may instead be housed in a common housing with the pumping plunger and other components of the unit pump. The inlet metering valve arrangement may be of the type that is controlled by electrical, and preferably electronic, means.

Figure 3:
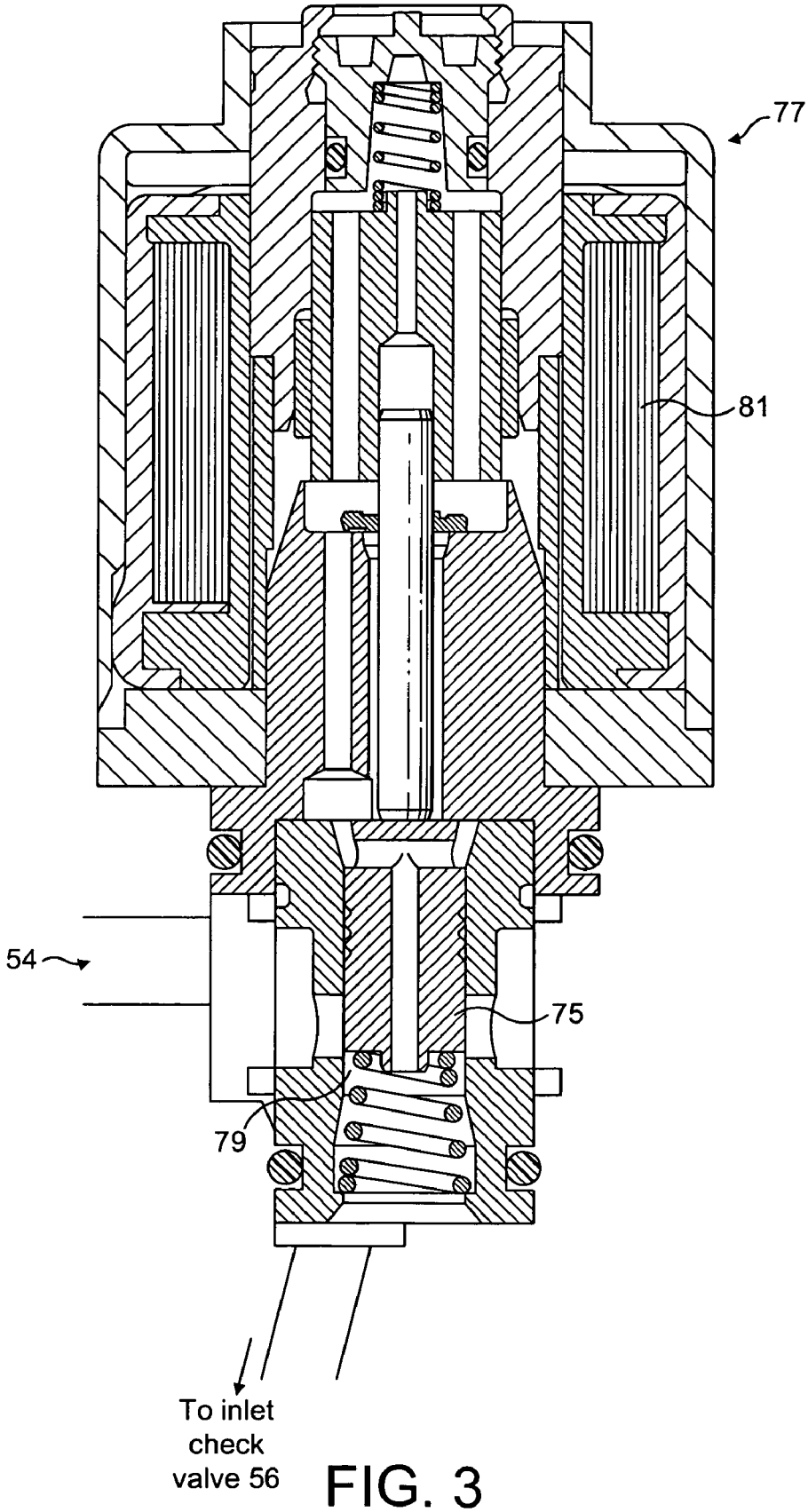
FIG. 3 is a sectional view of an inlet metering valve associated with the unit pump shown in FIG. 2.

The inlet metering valve 50 may typically be of the type shown in further detail in FIG. 3 wherein a metering valve member 75 is movable under the influence of an electromagnetic actuator, referred to generally as 77, to control the extent of opening of an orifice or restriction 79 in a flow path between the pump inlet 54 and the inlet check valve 56, thereby to vary the rate of flow of fuel through the orifice 79 to the pumping chamber 36. The metering valve member 75 is movable between a closed position, in which communication between the pump inlet 54 and the inlet check valve 56 through the orifice 79 is closed, and a fully open position, in which a maximum rate of flow of fuel through the orifice 79 is permitted. Movement of the metering valve member 75 is effected by energizing and de-energizing a winding 81 of the actuator 77 under the control of the ECU 74. Further details of the operation of a metering valve of the type shown in FIG. 3 will be familiar to those skilled in the art of engine fuel system design.

Returning to FIG. 2, the inlet check valve 56 of the second unit pump 14 includes a valve abutment member 60 defining a valve seat 62, with which a check valve member 58 is engageable to control the metered flow of fuel from the inlet metering valve 50 to the pumping chamber 36. The valve abutment member 60 is provided with axially and radially extending passages that communicate with one another such that, when the check valve member 58 is caused to lift from the valve seat 62, fuel delivered to the pump inlet 54 and passing through the inlet metering valve 50 is able to flow into the radially extending passage in the valve abutment member 60, into the axially extending passage and past the valve seat 62 into the pumping chamber 36. Although not shown in FIG. 2, in practice it may be desirable to provide the inlet check valve 56 with a relatively low spring pre-load to urge the check valve member 58 into a position, in which it engages the valve seat 62.

Whilst the flow into the pumping chamber 36 is controlled by means of the inlet metering valve 50 and the inlet check valve 56, the flow of fuel out of the pumping chamber 36 is controlled by means of an outlet delivery valve arrangement, referred to generally as 64. The outlet valve arrangement 64 takes the form of a ball valve having a ball 66 that is engageable with a further valve seat 68 to control fuel flow between the pumping chamber 36 and a high pressure supply line 70 forming part of or being in communication with the supply line 20. The outlet valve arrangement 64 may be provided with an outlet valve spring (not shown) having a relatively low pre-load that serves to urge the ball 66 into engagement with the further valve seat 68.

The high pressure flow line 70 is defined by a passage provided in an insert member 72 located, in part, within a further bore 73 provided within the pump housing 34 and partially extending from the pump housing 34. The high pressure flow line 70 is substantially coaxially aligned with the pumping plunger 30 and is arranged to communicate, at its end remote from the pump housing 34, with an end of the second supply line 20 to the common rail 22. Thus, in use, high pressure fuel delivered from the pumping chamber 36 to the high pressure flow line 70 is able to flow into the second supply line 20, and into the common rail 22, for delivery to the injectors 26.

In use, as the drive shaft is rotated and the roller 42 rides over the cam surface, the tappet 40 is caused to reciprocate within the guide bore 44, thereby imparting axial movement to the pumping plunger 30 as the tappet 40 is moved into engagement with, and moves with, the pumping plunger 30. A pumping cycle consists of two phases: a filling phase and a pumping phase. During the filling phase, the inlet check valve 56 is open to permit fuel delivery from the inlet metering valve 50 to the pumping chamber 36, and the outlet valve arrangement 64 is held closed by means of high pressure fuel within the high pressure flow line 70 to the common rail. During the filling phase, the pumping plunger 30 is urged outwardly from the plunger bore 32 to perform a return stroke due to the pressure exerted on the plunger 30 by the flow of fuel from the inlet metering valve 50, through the inlet check valve 56 and into the pumping chamber 36.

During a subsequent pumping phase of the pumping cycle, the inlet check valve 56 is caused to close due to increasing fuel pressure within the pumping chamber 36 as the plunger 30 starts to move inwardly under the drive of the tappet 40, to prevent further flow of fuel into the pumping chamber 36 from the inlet metering valve 50. Additionally, as fuel pressure within the pumping chamber 36 increases further, the outlet valve arrangement 64 is caused to open to permit pressurized fuel within the pumping chamber 36 to flow into the high pressure flow line 70. During the pumping phase the pumping plunger 30 is urged inwardly within the plunger bore 32, under the influence of the tappet 40 co-operating with the roller 42 and the driven cam surface, to cause fuel pressurization within the pumping chamber 36.

The sequence of events during a pumping cycle will now be described in further detail. At the start of the pumping cycle, the pumping plunger 30 adopts its innermost position within the plunger bore 32 (i.e. uppermost position in the orientation in FIG. 2) and fuel pressure within the pumping chamber 36 is high due to the pressurization caused by the previous pumping stroke. The outlet valve arrangement 64 is closed due to the equalization of fuel pressures in the pumping chamber 36 and the high pressure flow line 70. The tappet 40 is also at its innermost position in the guide bore 44, and high fuel pressure within the pumping chamber 36 serves to urge the pumping plunger 30 into contact with the tappet 40.

Upon commencement of its return stroke, the plunger member 30 is initially allowed to retract from the plunger bore 32 due to decompression within the pumping chamber 36 and retraction of the tappet 40 under the force of the return spring 48 as the roller 42 rides over the cam surface. As the pumping chamber 36 is decompressed, a point will be reached, at which the pressure in the pumping chamber 36 falls below the pressure required to lift the check valve member 58 from the valve seat 62 due to the flow of fuel from the inlet metering valve 50, and the next filling phase commences.

Further movement of the pumping plunger 30 outwardly from the plunger bore 32 is effected by a force due to pressure within the pumping chamber 36 caused by the flow of fuel from the inlet metering valve 50, through the radially and axially extending passages in the valve abutment member 60 and though the inlet check valve 56 into the pumping chamber 36. Further retraction of the tappet 40 from the guide bore 44 (i.e. outward movement of the tappet 40 from the bore 44) occurs under the force of the return spring 48, causing the roller 42 to ride over the cam surface.

During the filling phase, the ball 66 of the outlet valve arrangement 64 remains seated against the further valve seating 68 due to high pressure fuel within the high pressure flow line 70 and due to the force of the outlet valve spring.

After the tappet 40 reaches its outermost position within the guide bore 44, the roller 42 is urged in an upward direction (in the illustration shown in FIG. 2) as it follows the cam surface, and a point will be reached, at which the tappet 40 moves into engagement with the plunger member 30, thereby causing the pumping plunger 30 to be driven inwardly within the plunger bore 32. As the pumping plunger 30 is driven inwardly within the plunger bore 32, fuel within the pumping chamber 36 is pressurized.

As fuel pressure within the pumping chamber 36 starts to increase, a point will be reached part way through the pumping stroke, at which point, the check valve member 58 of the inlet check valve 56 is urged against its seating, due to increasing fuel pressure within the pumping chamber 36, to prevent further flow of fuel into the pumping chamber 36 and return flow from the pumping chamber 36 towards the inlet metering valve 50.

As the plunger pumping stroke continues, fuel within the pumping chamber 36 is pressurized to a sufficiently high level to cause the ball 66 to lift from the further valve seating 68, thereby permitting pressurized fuel to flow from the pumping chamber 36 into the high pressure flow line 70 and, hence, to the supply line 20 to the common rail 22. At the end of the pumping stroke, when the pumping plunger 30 reaches the end of its range of travel, the ball 66 will be urged against the further valve seating 68 due to high pressure fuel within the high pressure flow line 70 and the force of the outlet valve spring, thereby holding high fuel pressure within the high pressure flow line 70, the second supply line 20 and, hence, within the common rail 22.

The extent of plunger movement during the pumping stroke will be determined by the quantity of fuel delivered to the pumping chamber 36 during a filling phase, as this determines the extent to which the pumping plunger 30 is retracted from the plunger bore 32 during the return stroke. The quantity of fuel delivered to the pumping chamber 36 during the filling phase therefore determines the point in the range of travel of the tappet 40, at which it engages the pumping plunger 30 to commence the plunger pumping stroke.

The quantity of fuel delivered to the pumping chamber 36 during one pumping cycle is therefore determined by the rate of flow of fuel through the inlet metering valve 50, and the time for which the inlet check valve 56 is held open to permit fuel flow into the pumping chamber 36. The time, for which the inlet check valve 56 is held open, is determined by: (i) the spring rate of the inlet valve spring (if provided); (ii) the hydraulic force acting on the check valve member 58 as fuel is pressurized within the pumping chamber 36; (iii) and the speed of the associated engine, which determines the rate of movement of the tappet 40. The quantity of fuel delivered to the pumping chamber 36 can therefore be varied by adjusting the inlet metering valve setting to vary the fuel flow rate through the inlet check valve 56.

Figure 4:
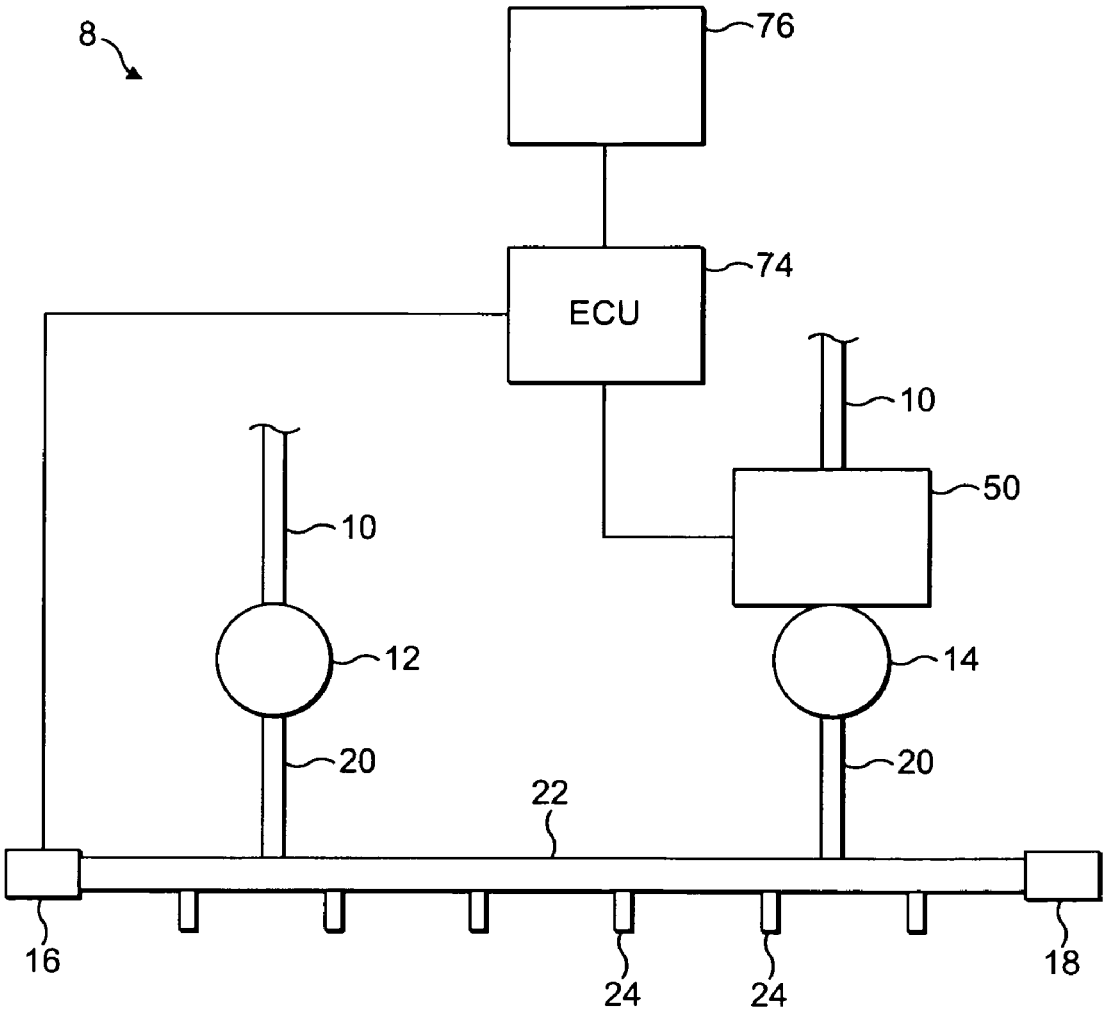
FIG. 4 is a block diagram of the fuel injection system of FIG. 1, showing how the system is controlled by an ECU taking engine load data input from an engine load sensor.

With reference the system block diagram of FIG. 4, the inlet metering valve 50 of the second unit pump 14 is operable by means of the ECU 74 between a fully open state, corresponding to maximum filling and a maximum pumping plunger stroke, and a fully closed state corresponding to zero filling and zero pumping plunger stroke, and has a range of settings between its fully open and closed states to vary the extent of filling of the pumping chamber 36 and, hence, the quantity of fuel delivered by the second unit pump 14 to the common rail 22 during any given pumping cycle.

So, in this embodiment of the invention, low pressure fuel delivered to the inlet check valve 56 is regulated by means of the inlet metering valve 50 to control the quantity of fuel pumped within the pumping chamber 36 of the second unit pump 14 during a pumping cycle. The provision of the inlet metering valve 50 provides the advantage that only the quantity of fuel required for an injection event is pumped during a pumping cycle. This provides improved mechanical efficiency over pump designs wherein an excess quantity of fuel is pumped on each pumping stroke, with the excess being spilled to a drain port prior to delivery to the injectors.

Although the flow rate of fuel required for an injection event may be greater than can be provided by a single unit pump 12, fuel injection demand is satisfied throughout the engine load range because two or more unit pumps 12, 14 are used and can work in parallel when necessary. Specifically, by using the ECU 74 to control the inlet metering valve 50 in response to engine load data provided to the ECU 74 by, for example, a load sensor 76 as shown in FIG. 4, the second unit pump 14 can be activated when higher fuel flow rates are required, such as during medium- and high-load operation or during engine starting. Conversely, when the engine is idling or in other low-load operation, the second unit pump 14 can be, in effect, shut down; the first unit pump 12 is configured such that its fuel delivery rate alone is sufficient for those less demanding operating conditions. The ECU 74 can also respond to the pressure sensor 16 on the common rail 22 to control the second unit pump 14 to adjust the fuel pressure in the common rail 22 as necessary.

The first unit pump 12 runs constantly as the engine is running, albeit at a speed that varies with engine speed, and its delivery is not controlled by the ECU 74 or otherwise. The fuel injection system of the invention therefore the potential for low cost as the need to control two pumps is avoided. The system is especially suitable for use in engines for cost-sensitive markets where a higher level of fuel pressure fluctuation and hence engine torque output can be accepted. The system gives better efficiency than a system that includes completely uncontrolled pumps wherein surplus high pressure fuel is simply discharged from the system by, for example, a high pressure discharge valve on the common rail.

The invention has the advantage that it allows the use of two pumps where adequate capacity cannot be obtained with one pump without the necessity to balance the two pumps and their associated plumbing to give proper operation with a single inlet metering valve. This may be useful where the engine construction is such that a single inlet metering valve cannot be conveniently mounted in a way that feeds the two pumps equally.

At low load, when only the first unit pump 12 is working, the working stroke of that single working pump will be greater than if two pumps were together pumping the same flow rate of fuel. This will give rise to less plunger leakage than would be the case for two pumps working with lesser strokes, hence improving pumping efficiency.

Figure 5:
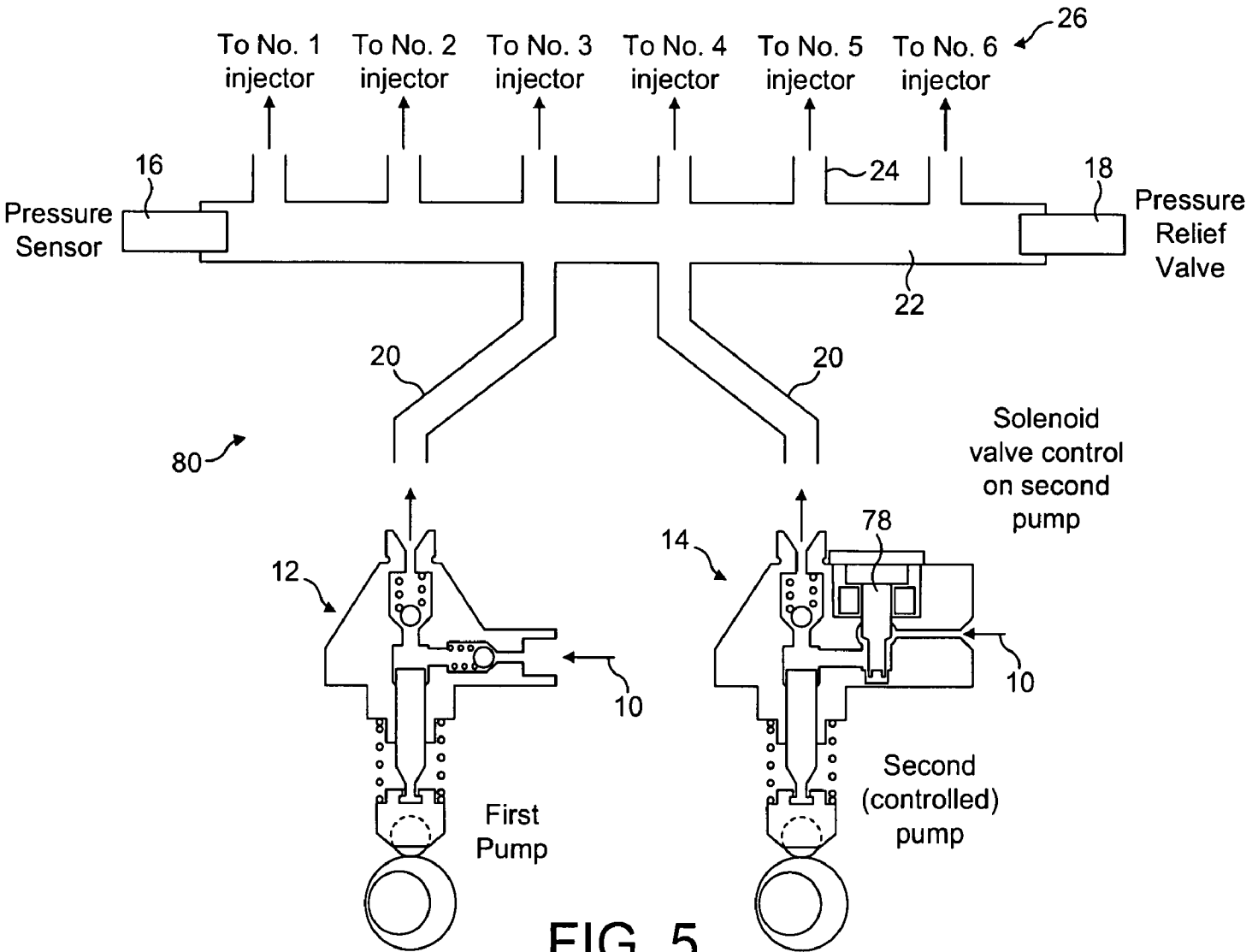
FIGS. 5 and 6 are schematic diagrams of fuel injection systems that illustrate alternative embodiments of the present invention having different unit pump control means.

Whilst variable delivery of the second unit pump 14 can be achieved by inlet metering as described above, it can also be achieved by other means. For example, the variable delivery of the second unit pump 14 can be controlled by using a solenoid valve 78 as shown in the system 80 of FIG. 5. This allows excess fuel to flow back from the pumping chamber at low pressure when not required and hence controls the effective stroke, as is done by the solenoid-controlled spill valve used in Delphi's currently-marketed EUI (electronic unit injector) and EUP (electronic unit pump) arrangements.

Figure 6:
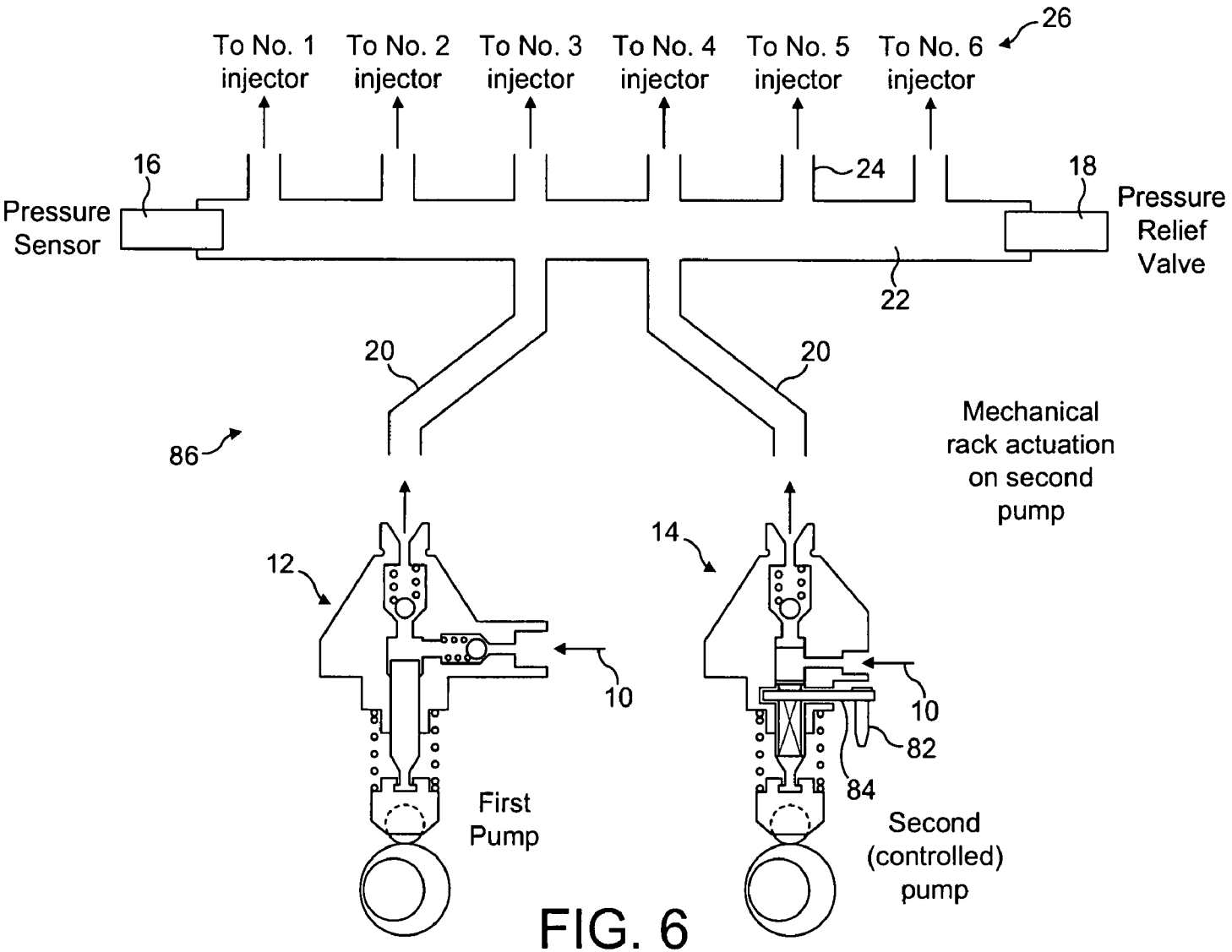

Theoretically mechanical control, as used in a mechanical unit pump, could also be used with rack actuation, for example, by a stepper motor 82 and rack 84 as shown in the system 86 of FIG. 6 to alter the effective stroke of the plunger of the second unit pump 14.

In the preferred embodiments shown, the fuel injection system of the invention includes a number of fuel injectors that is greater than the number of unit pumps. For example, if there are four engine cylinders, and hence four fuel injectors, there may only be two or three unit pumps. In that case, an existing camshaft of the engine, which was designed for use with four unit pumps (and hence four fuel injection system cams), will have at least one redundant cam. In general, therefore, the camshaft may be formed with or may carry a plurality of cams, at least one of which does not have an associated unit pump and, therefore, is redundant.

It will be appreciated that although the fuel injection system of the present invention is shown to include unit pumps having a tappet drive arrangement that co-operates with its associated cam, other drive arrangements are also possible, for example shoe and roller arrangements. Also, the principle of this invention can be used in a rotary drive pump containing two or more pumping units within a common housing.

The invention claimed is:

1. A fuel injection system for an internal combustion engine, the system comprising:

a plurality of pumps arranged to supply respective flows of pressurized fuel to a common accumulator volume that, in turn, supplies the pressurized fuel to a plurality of fuel injectors;

an engine control unit for controlling the flow rate of pressurized fuel into the accumulator volume in response to engine load; and an engine load data input for inputting engine load data to the engine control unit;

wherein the flow rate of pressurized fuel from at least one first pump of the plurality is substantially constant at a given engine speed; and wherein at least one second pump of the plurality of pumps comprises a fuel output control that is responsive to the engine control unit for varying the amount of fuel pressurized by that pump, thereby enabling the flow rate of pressurized fuel from that pump to be varied over a range of settings at the given engine speed, whereby the engine control unit controls the aggregate flow rate of pressurized fuel from the pumps into the accumulator volume.

2. The system of claim 1, wherein the fuel output control comprises an inlet metering valve arranged to control the rate of flow of fuel into the second pump.

3. The system of claim 1, wherein the fuel output control comprises a solenoid-controlled spill valve acting on the second pump.

4. The system of claim 1, wherein the fuel output control comprises a mechanical control to alter the effective stroke of a plunger of the second pump.

5. The system of claim 4, wherein the mechanical control comprises a rack acting on the plunger of the second pump.

6. The system of claim 5, wherein the rack is actuated by a stepper motor.

7. The system of claim 1, wherein the pumps are unit pumps.

8. The system of claim 7, wherein the unit pumps have a cam-driven tappet drive arrangement.

9. The system of claim 7, wherein the unit pumps have a shoe and roller drive arrangement.

10. The system of claim 1, wherein the pumps are pumping units of a rotary drive pump.

11. The system of claim 10, wherein the pumping units of the rotary drive pump are disposed within a common housing.

12. The system of claim 1, wherein the accumulator volume is a common rail.

13. The system of claim 1, wherein the number of fuel injectors is greater than the number of unit pumps.

14. The system of claim 1, wherein the first pump has substantially constant delivery at a given engine speed and the second pump has variable delivery at that engine speed.

15. A fuel injection system for an internal combustion engine, the system comprising:

a plurality of pumps arranged to supply respective flows of pressurized fuel to a common accumulator volume that supplies the pressurized fuel in turn to a plurality of fuel injectors;

an engine control unit for controlling the flow rate of pressurized fuel into the accumulator volume in response to engine load; and an engine load data input for inputting engine load data to the engine control unit;

wherein at least one pump of the plurality has an uncontrolled fuel output; and at least one other pump of the plurality comprises a fuel output control responsive to the engine control unit to control the aggregate flow rate of pressurized fuel from the pumps into the accumulator volume, wherein the amount of fuel pressurized by the at least one other pump is capable of being varied at a given engine speed, thereby varying the flow rate of pressurized fuel from the at least one other pump at the given engine speed.

16. A method of operating a fuel injection system of an internal combustion engine, the method comprising:

driving a plurality of pumps to supply respective flows of pressurized fuel to a common accumulator volume; and controlling the amount of fuel pressurized by at least one, but less than all, of the plurality of pumps in response to engine load, thereby controlling the flow rate of pressurized fuel therefrom to control the aggregate flow rate of pressurized fuel from the pumps into the accumulator volume wherein the amount of fuel pressurized by at least one of the plurality of pumps is varied over a range of settings at a given engine speed.

17. The method of claim 16, wherein the flow rate of pressurized fuel from at least one of the plurality of pumps is dependent on engine speed.

18. An engine fitted with a fuel injection system as defined in claim 1 or capable of operating in accordance with the method of claim 16.

* * * * *